US009437952B2

(12) United States Patent
Borkar et al.

(10) Patent No.: US 9,437,952 B2
(45) Date of Patent: Sep. 6, 2016

(54) CONNECTOR ASSEMBLY HAVING SELF-ADJUSTING MALE AND FEMALE CONNECTOR ELEMENTS

(71) Applicant: Appleton Grp LLC, Rosemont, IL (US)

(72) Inventors: Tushar Yadunath Borkar, Pune (IN); Shivlingayya Swami, Pune (IN); Vinaya Nandish Kubsad, Pune (IN); Vikramsinh Mohite, Sangli (IN); Nabil Mina, Rosemont, IL (US)

(73) Assignee: Appleton Grp LLC, Rosemont, IL (US)

( * ) Notice: Subject to any disclaimer, the term of this patent is extended or adjusted under 35 U.S.C. 154(b) by 0 days.

(21) Appl. No.: 14/989,262

(22) Filed: Jan. 6, 2016

(65) Prior Publication Data

US 2016/0197429 A1 Jul. 7, 2016

(30) Foreign Application Priority Data

Jan. 7, 2015 (IN) ..... 60/MUM/2015
Jan. 21, 2015 (IN) ..... 208/MUM/2015

(51) Int. Cl.
*H01R 13/05* (2006.01)
*H01R 13/42* (2006.01)
*H01R 13/04* (2006.01)

(52) U.S. Cl.
CPC ..... *H01R 13/42* (2013.01); *H01R 13/04* (2013.01)

(58) Field of Classification Search
CPC ..... H01R 13/05
USPC ..... 439/265, 825
See application file for complete search history.

(56) References Cited

U.S. PATENT DOCUMENTS 377,237 A * 1/1888 Cole ..... H01R 31/08 200/253.1
1,605,904 A * 11/1926 Van Brunt ..... H01R 13/20 439/265
1,956,037 A * 4/1934 MacDonald ..... H01R 13/20 439/848
2,780,792 A * 2/1957 Earl ..... H01R 13/05 439/732
3,145,069 A 8/1964 Damon et al.
3,187,291 A * 6/1965 Hime ..... H01R 13/20 439/259

(Continued)

FOREIGN PATENT DOCUMENTS

DE 3219511 10/1982
DE 19939089 2/2000
EP D874417 10/1998

*Primary Examiner* — Neil Abrams
(74) *Attorney, Agent, or Firm* — McDonnell Boehnen Hulbert & Berghoff LLP

(57) ABSTRACT

A connector assembly includes a male connector element that is manually expandable to control tightness of fit in a and a female connector element. The male connector element is having a first and a second portion configured by longitudinally bi-furcating the male connector element and includes a chamfered portion, a radially adjusting mechanism and a screw. The chamfered portion is axially configured on male connector element and receives the radially adjusting mechanism that moves the first and second portions relative to each other. The screw axially passes through male connector element and radially moves the radially adjusting mechanism to adjust the gap between the first and second portions to adjust external dimension of male connector element. The female connector element is having a tubular configuration that receives male connector element and is having a plurality of longitudinal slits configured thereon, walls of the female connector element are urged radially inwards towards the male connector element to maintain contact there-between by a spring element.

10 Claims, 4 Drawing Sheets

(56) References Cited

U.S. PATENT DOCUMENTS 3,662,296 A * 5/1972 Newman ..... H01R 13/44 439/135
3,789,346 A * 1/1974 De Brick ..... H01R 13/02 439/283
3,924,922 A * 12/1975 DeCenzo ..... H01R 13/18 439/839
4,111,509 A * 9/1978 Novak ..... H01R 24/30 439/102
4,237,353 A 12/1980 Nemenz
4,405,195 A * 9/1983 Cherry ..... H01R 13/193 439/825
4,632,496 A 12/1986 Williams
5,108,301 A * 4/1992 Torok ..... H01R 13/20 439/263
5,194,013 A * 3/1993 Propp ..... H01R 13/6392 439/102
5,197,908 A * 3/1993 Nelson ..... H01R 13/052 439/825
5,344,329 A * 9/1994 Faller ..... H01R 13/443 439/133
5,423,692 A * 6/1995 Francis ..... H01R 13/213 439/335
5,480,318 A * 1/1996 Garrison ..... H01R 13/20 439/102
5,482,480 A * 1/1996 Miyazaki ..... H01R 13/193 439/772
5,893,782 A * 4/1999 Harting ..... H01R 13/17 439/265
6,080,002 A * 6/2000 Macleod ..... H01R 13/207 439/102
6,530,794 B2 * 3/2003 Littlewood ..... H01R 13/523 439/265
6,649,983 B2 11/2003 Chatterjee
6,955,569 B2 10/2005 Baker et al.
7,442,096 B1 * 10/2008 Gilliam ..... H01R 13/44 439/149
7,658,657 B1 * 2/2010 Scanzillo ..... H01R 13/17 439/825
7,955,144 B2 * 6/2011 Thoerner ..... H01R 4/36 439/825
9,273,496 B2 * 3/2016 Theobald ..... E05B 73/0005
9,293,850 B2 * 3/2016 Gilliam ..... H01R 13/04
2010/0003866 A1 1/2010 Dent et al.

* cited by examiner

CONNECTOR ASSEMBLY HAVING SELF-ADJUSTING MALE AND FEMALE CONNECTOR ELEMENTS

RELATED APPLICATIONS

This application claims priority to Indian Patent Application No. 60/MUM/2015 filed Jan. 7, 2015, entitled "A CONNECTOR ASSEMBLY HAVING SELF-ADJUSTING MALE AND FEMALE CONNECTOR ELEMENTS" and Indian Patent Application No. 208/MUM/2015 filed Jan. 21, 2015, entitled "A CONNECTOR ASSEMBLY HAVING SELF-ADJUSTING MALE AND FEMALE CONNECTOR ELEMENTS."

FIELD

The present disclosure relates to a connector assembly, particularly, the present disclosure relates to a connector assembly that achieves a desired fit between male and female connector sub-assemblies thereof.

BACKGROUND

The connectors are used in various applications, for example, electrical connectors are used for connecting electrical elements used for continuous transmission of power. Generally, the connector assembly includes a male connector sub-assembly and a female connector sub-assembly. The male connector sub-assembly includes a conductive male pin contact at the front and the base portion for electrical wire termination or connection with an insulated cover body assembled over the conductive male pin contact. The female connector sub-assembly includes a conductive female sleeve contact at the front and the base portion for electrical wire termination or connection with an insulated cover body assembled on the conductive female sleeve contact.

The conductive female sleeve contact of the female connector sub-assembly receives the conductive male pin contact of the male connector sub-assembly for configuring the connector assembly. The male and female connector sub-assemblies are connected to each other via engagement between the conductive male pin contact and the conductive female sleeve contact to configure the connector assembly used for continuous transmission of power in the most extreme conditions. Typical applications include use as a connector assembly for transmission of power from generator sets to switchgear or SCR (silicon-controlled rectifiers) controls, from a control house to the traction motors, mud pumps, draw works, rotary tables, cement pumps and top drives. More specifically, the electrical connector assembly is used for connecting an electrical cable to a fixed mating connector. Certain electrical connector assemblies are configured specifically to cater to the drilling rig industry. These connector assemblies are configured for applications where the connector assemblies are required to operate in the most extreme service conditions and are subjected to up to 1,000 Volts AC or DC voltage and up to 1,135 Amps of continuous power.

The field assembly and the installation of many inland drilling rigs have been using single pole electrical connector assemblies that can be prepared in the field. These connector assemblies take different forms, including pin and collet type connector assemblies or plug and receptacle type connector assemblies. All of these types of connector assemblies, particularly, the plug and receptacle type connector assemblies require a desired fit between elements of a plug or a male connector sub-assembly and a receptacle or a female connector sub-assembly to ensure minimal resistance to the high current loads.

However, due to the extreme service conditions to which the connector assembly is subjected to, it is difficult to maintain a desired fit between the elements of the male and female connector sub-assemblies of the connector assembly. Particularly, the connector assemblies are subjected to most extreme service conditions and have to withstand vibrations, shocks and wear and tear. Generally, the elements of the male and female connector sub-assemblies, particularly, the engaging conductive male pin contact and conductive female sleeve contact wear out and fail to maintain the necessary tight fit between the male and female connector sub-assemblies and because of improper contact between the male and female connector sub-assemblies, the connection assembly fails to efficiently transmit power there-though due to high resistance to the high current loads and there are chances of power leakage and damage to the connector assembly.

To achieve the desired fit between the conductive male pin contact and the conductive female sleeve contact of the respective male and female connector assemblies of the connector assembly, the use of a self-adjustable male connector assembly has been suggested in the prior art, wherein the conductive male pin contact of the male connector assembly has a split pin configuration that facilitates in adjusting the conductive male pin's external diameter. In case of the split pin configuration of the conductive male pin contact, the conductive male pin contact is cut into two halves by a slot cut along the length of the conductive male pin contact. A Belleville washer and a fixing stud mechanism are generally used within the slot to make small adjustments in the external diameter of the conductive male pin contact. A fixing stud is driven into the conductive male pin contact that exerts a force against the Belleville washer. By increasing this force, the two sides of the conductive male pin contact are separated and selectively urged away from each other resulting in a slight increase in the diameter of the conductive male pin contact to ensure the necessary fit thereof with the female sleeve contact of the female connector sub-assembly. The female sleeve contact of the female connector sub-assembly has a uniform internal diameter along the conductive length thereof for receiving the conductive male pin contact therein.

However, such a configuration of connector assembly wherein diameter of the conductive male pin contact can be adjusted has certain drawbacks associated therewith. More specifically, the variable diameter conductive male pin contact of the male connector sub-assembly of the connector assembly is field adjustable, however, adjusting the diameter of the conductive male pin contact in the field is not desirable as field operators often lack the knowledge and expertise to make the fine adjustments required for such connections. Accordingly, there is a need for a connector assembly that provides selective access to the adjusting mechanism of the conductive male pin connector of the male connector sub-assembly and may only permit factory adjustment of the male and female connector sub-assemblies for achieving the necessary fit between the conductive male pin contact and the conductive female sleeve contact of the respective male and female connector assemblies by skilled and trained professionals only and restrains field adjustment of the conductive male pin contact and the conductive female sleeve contact of the respective male and female connector assemblies.

The prior art also discloses a connector assembly that permits factory adjustment of the connector sub-assemblies for achieving the necessary fit between engaging elements of the connector sub-assemblies, for example, U.S. Pat. No. 7,442,096 discloses a connector assembly having a variable diameter conductive male pin contact that permits factory adjustment only. More specifically, the conductive male pin contact of the connector assembly includes an adjustment port with threaded hole configured on one side of the tip of the conductive male pin contact, wherein the port receives an adjustment screw that urges a Belleville washer arrangement disposed within a slit axially configured on the conductive male pin contact for adjusting the diameter of the conductive male pin contact by adjusting spacing between the portions of the conductive male pin contact separated by the slot. The access to the adjustment screw is selective so that the adjustment of the conductive male pin's diameter can be performed by skilled and trained professionals only. More specifically, the male sub-assembly includes an adjustment port safety cap for providing selective access to the adjustment screw for permitting factory adjustment of the conductive male pin's diameter only. Such a configuration of the male connector sub-assembly facilitates adjustment of the conductive male connector pin's diameter prior to installation of the safety cap. However, such configuration of the adjustment mechanism for adjusting conductive the male connector pin's diameter is ineffective because of limited contact between the Belleville of the Belleville washer arrangement and the portions of the conductive male connector pin separated by the slot. Further, the gap between the portions of the conductive male connector pin is increased to increase the diameter of the conductive male connector pin by decompressing the Belleville washer arrangement and is not controlled. Further, with such configuration the adjusting of diameter of the conductive male connector pin is not uniform along the contact length.

However, none of the prior art provides any provision for adjusting the dimension of the conductive female sleeve contact of the female connector sub-assembly for ensuring a tight fit between the male and female connector sub-assemblies. More specifically, the contact surface of the conductive female sleeve contact wears during service after assembly and may cause a poor fit between the conductive male pin contact and the conductive female sleeve contact of the respective male and female connector assemblies. In case of a conventional connector assembly, the contact force between the contact surface of the conductive male pin contact and the conductive female sleeve contact of the respective male and female connector assemblies is not uniform along the length of the connector assembly, particularly, the contact force varies from a maximum at the tip of the conductive male pin contact to a minimum at the tip of the conductive female sleeve contact and is detrimental for maintaining proper contact between the engaging elements of the male and female connector assemblies that results in inefficient power transmission.

Accordingly, there is a need for a connector assembly that has provision for adjusting the internal diameter of the conductive female sleeve contact of the female connector sub-assembly along with provision for adjusting the external diameter of the conductive male connector pin of the male connector sub-assembly for ensuring a tight fit between the male and female connector sub-assemblies. Further, there is a need for a connector assembly that ensures uniform contact force between the contact surfaces of the conductive male connector pin and conductive female sleeve of the respective male and female connector assemblies along the length of the connector assembly. Further, there is a need for a connector assembly having such a configuration that the access to the adjustment mechanism for adjusting the internal and external diameters of the conductive male connector pin and conductive female sleeve of the respective male and female connector sub-assemblies is selective so as to permit factory adjustment of the engaging elements of the male and female connector sub-assemblies by skilled and trained professionals only.

OBJECTS

Some of the objects of the present disclosure aimed to ameliorate one or more problems of the prior art or to at least provide a useful alternative are listed herein below.

An object of the present disclosure is to provide a connector assembly having self-adjusting male and female connector sub-assemblies for improving contact and achieving necessary fit between the engaging elements of the male and female connector sub-assemblies.

Another object of the present disclosure is to provide a connector assembly that ensures uniform contact force between the contact surfaces of the conductive male connector pin and conductive female sleeve of the respective male and female connector assemblies along the length of the connector assembly.

Still another object of the present disclosure is to provide a connector assembly, wherein the connector assembly has such a configuration that permits factory adjustment of engaging elements, particularly, conductive male connector pin and conductive female sleeve of respective male and female connector sub-assemblies thereof by skilled and trained professionals only and restrains field adjustment of the engaging elements.

Yet another object of the present disclosure is to provide a connector assembly that prevents unintentional disengagement between conductive male pin and conductive female sleeve of respective male and female connector sub-assemblies of the connector assembly.

Still another object of the present disclosure is to provide a connector assembly that is simple in construction and convenient to use.

Another object of the present disclosure is to provide a connector assembly that is reliable.

Another object of the present disclosure is to provide a connector assembly that requires minimum maintenance.

Still another object of the present disclosure is to provide a connector assembly that is tamper resistant.

Another object of the present disclosure is to provide a connector assembly that maintains necessary fit between the engaging elements of the male and female connector sub-assemblies even after regular and pro-longed service and exhibits enhanced service life.

Still another object of the present disclosure is to provide a connector assembly that has ergonomic construction and that permits convenient release of a connection between engaging elements of the male and female connector sub-assemblies of the connector assembly when intended.

Yet another object of the present disclosure is to provide a connector assembly for a panel mounting system that is easy to use and configures a secure connection between male and female sub-assemblies of the connector assembly.

Another object of the present disclosure is to provide a connector assembly that is having quick-connect feature for achieving quick assembly between male and female sub-assemblies of the connector assembly.

Yet another object of the present disclosure is to provide a connector assembly that ensures better surface contact between conductive male connector pin and conductive female sleeve of respective male and female connector sub-assemblies while still requiring lesser insertion forces, thereby enhancing the service life of the connection assembly.

Another object of the present disclosure is to provide a connector assembly that eliminates chances of field adjustment by unskilled field operators by not providing any provision for field adjustment, thereby reducing assembly time and eliminating the risks of accidents, disruption of services due to improper fitment of engaging elements of male and female connector sub-assemblies thereof by unskilled field operators.

Still another object of the present disclosure is to provide a connector assembly that provides interchangeability with existing connector assembly already being used.

Other objects and advantages of the present disclosure will be more apparent from the following description when read in conjunction with the accompanying figures, which are not intended to limit the scope of the present disclosure.

SUMMARY

A connector assembly is disclosed in accordance with an embodiment of the present disclosure. The connector assembly includes a male connector sub-assembly and a female connector sub-assembly. The male connector sub-assembly includes a conductive male pin contact shrouded by an insulator cover body. The conductive male pin contact includes a first and a second portion configured by longitudinally bi-furcating the conductive male pin contact. The conductive male pin contact includes a chamfered portion, a radially adjusting mechanism and an adjustment screw. The chamfered portion is axially configured on the conductive male pin contact. The radially adjusting mechanism is received within the chamfered portion and moves the first and second portions of the conductive male pin contact relative to each other. The adjustment screw axially passes through the conductive male pin contact and interacts with and radially moves the radially adjusting mechanism to adjust the gap between the first and second portions to adjust conductive male pin contact's external diameter. The insulated cover body is assembled over the conductive male pin contact. The female connector sub-assembly includes a conductive female sleeve contact shrouded by another insulated cover body. The conductive female sleeve contact is having a tubular configuration that receives the conductive male pin contact. The conductive female sleeve contact further includes a plurality of longitudinal slits configured thereon, wherein walls of the conductive female sleeve contact are urged radially inwards towards the conductive male pin contact received therein to maintain contact therebetween by a spring element circumscribing the conductive female sleeve contact.

Typically, either of the conductive male pin contact and conductive female sleeve contact of the respective male and female connector assemblies are self-adjustable for facilitating adjusting of respective external and internal diameters thereof.

Alternatively, both of the conductive male pin contact and conductive female sleeve contact of the respective male and female connector assemblies are self-adjustable for facilitating adjusting of respective external and internal diameters thereof.

Typically, the first and the second portions are identical as the first and second portions are configured by longitudinally bi-furcating the conductive male pin contact along a plane passing through center of the conductive male pin contact.

Alternatively, the first and the second portion are non-identical as the first and second portions are configured by longitudinally bi-furcating the conductive male pin contact along a plane passing offset from the center of the conductive male pin contact.

Typically, the radially adjusting mechanism is a Belleville washer sub-assembly that includes an operative bottom Belleville washer and an operative top Belleville washer. The operative bottom Belleville washer rests on the chamfered portion and is functionally coupled to the first and second portions of the conductive male pin contact. The operative top Belleville washer is spaced from the operative bottom Belleville washer and is moved relative to the operative bottom Belleville washer by the adjustment screw to cause radial movement of the operative bottom Belleville washer for facilitating adjusting of gap between the first and second portions of the conductive male pin contact, thereby adjusting conductive male pin contact's external diameter.

Alternatively, the radially adjusting mechanism is a conical spring sub-assembly that includes a conical spring element and a washer. The conical spring element rests inside a conical cavity configured on an operative top end of the conductive male pin contact and is functionally coupled to the first and second portions of the male connector element. The washer is disposed over the conical spring element and is moved relative to the conical spring element by the adjustment screw to cause radial movement of the conical spring element for facilitating adjusting of the gap between the first and second portions of the conductive male pin contact, thereby adjusting the conductive male pin contact's external diameter.

Further, the connector assembly includes a safety cap secured to an end portion of the conductive male pin contact for providing selective access to the adjustment screw for permitting factory adjustment of conductive male pin contact only.

Typically, the adjustment screw engages with a threaded hole that is axially extending through the conductive male pin contact.

BRIEF DESCRIPTION

The system of the present disclosure will now be described with the help of the accompanying drawings, in which.

Figure 4A:
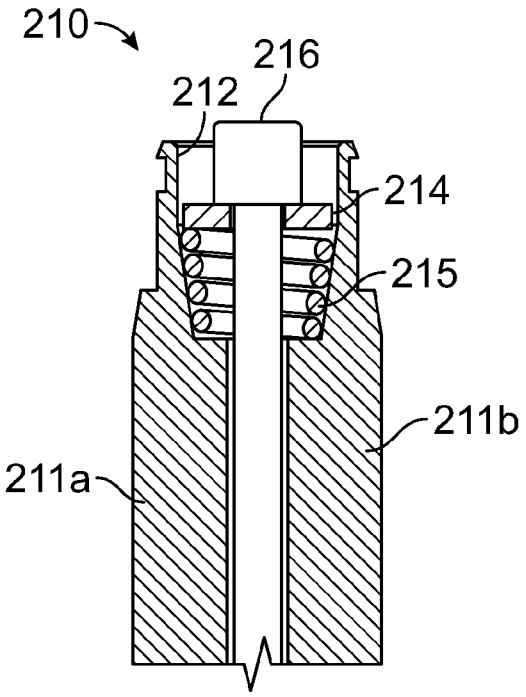
FIG. 4A illustrates an enlarged view of a self-adjusting conductive male pin contact, wherein a radially adjusting mechanism of the self-adjusting conductive male pin contact is a conical spring sub-assembly and the conical spring is illustrated in a non-compressed configuration.
Figure 4B:
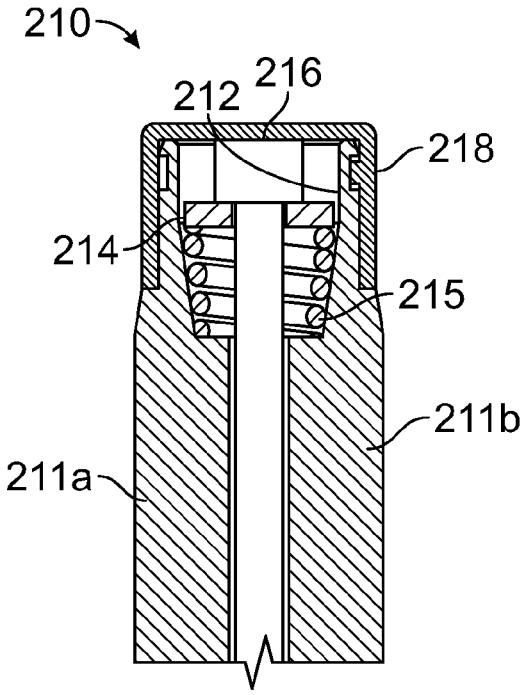
Figure 5:
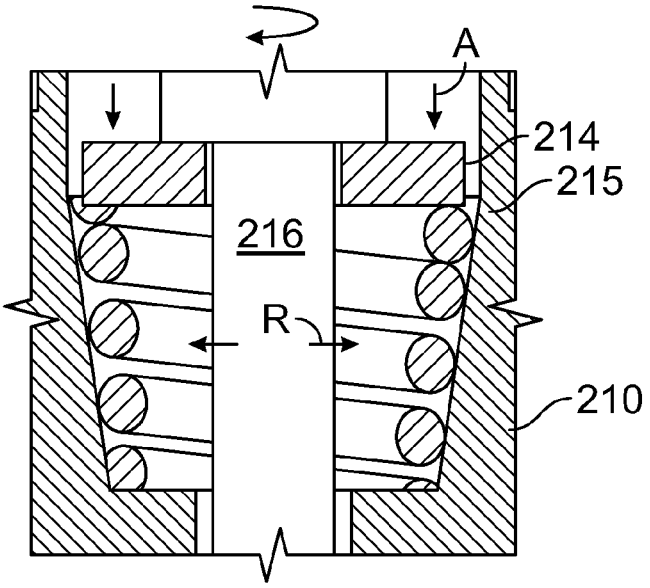

FIG. 4B illustrates a enlarged view of the self-adjusting conductive male pin contact of FIG. 4A, wherein the conical spring is illustrated in a compressed configuration and a safety cap is assembled to an end portion of the conductive male pin contact for providing selective access to an adjustment screw; and FIG. 5 illustrates a schematic representation explaining operation of the conical spring sub-assembly of FIG. 4B, wherein axial compression of a conical spring by a washer urged by the adjustment screw causes radial movement of the portions of the conductive male pin contact.

DETAILED DESCRIPTION

The connector assembly of the present disclosure will now be described with reference to the embodiments shown in the accompanying drawings. The embodiments do not limit the scope and ambit of the disclosure. The description relates purely to the examples and preferred embodiments of the disclosed device and its suggested applications.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The present disclosure envisages a connector assembly. The connector assembly includes a male connector sub-assembly and a female connector sub-assembly. The male connector sub-assembly includes a conductive male pin contact and an insulated cover body for the conductive male pin contact. The female connector sub-assembly includes a conductive female sleeve contact and an insulated cover body for the conductive female sleeve contact. The conductive female sleeve contact is self-adjusting and has provision for adjusting a conductive diameter of conductive female sleeve contact. The conductive male pin contact is self-adjusting and has provision for adjusting the conductive male pin contact's external diameter for ensuring a tight fit between the conductive male pin contact and the conductive female sleeve contact of the respective male and female connector sub-assemblies, thereby ensuring proper electrical contact between the conductive male pin contact and the conductive female sleeve contact of the respective male and female connector assemblies and efficient power transmission. The male connector sub-assembly of the connector assembly has such a configuration that the access to an adjustment mechanism for adjusting the conductive male pin contact's external diameter is selective so as to permit factory adjustment of the conductive male pin contact's external diameter by skilled and trained professionals only. The adjustment mechanism for adjusting the conductive male pin contact's external diameter is a Belleville washer mechanism that urges portions of the conductive male pin contact radially outwards. The Belleville washer adjustment mechanism is positioned vertically with the Belleville washers coaxially arranged within a chamfered portion configured on the conductive male pin contact and an axially moving adjustment screw actuates the Belleville washers to cause radial movement of the Belleville washer mechanism unlike conventional adjustment arrangement in which the radial movement of the adjustment screw actuates the Belleville washer mechanism. The self-adjusting conductive female sleeve contact of the female connector sub-assembly has two (or more) longitudinal slits extending along the contact length thereof and a wire spring circumscribing the conductive female sleeve contact urges the conductive female sleeve contact radially inwards towards the conductive male pin contact received therein to maintain contact force between the conductive male pin contact and the conductive female sleeve contact of the respective male and female connector sub-assemblies. With such configuration of the conductive female sleeve contact of the female connector sub-assembly the conductive diameter of the conductive female sleeve contact of the female connector sub-assembly is made adjustable and the wearing of the contact surface of the conductive female sleeve contact of the female connector sub-assembly is reduced. Further, with such configuration the connector assembly achieves good contact force and good contact area between the conductive male pin contact and the conductive female sleeve contact of the respective male and female connector sub-assemblies. Still further, with such configuration the connector assembly achieves efficiently distributed contact force along the contact length as the Belleville washer arrangement in the conductive male pin contact and the external wire spring circumscribing the conductive female sleeve contact exert radial contact force at both the ends of contact length.

Figure 1A:
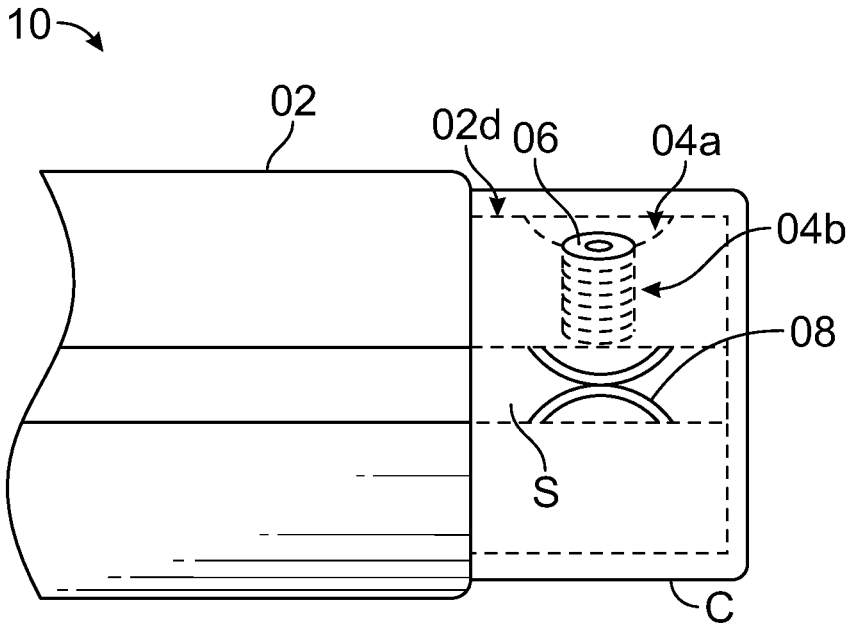
FIG. 1A (Prior Art)
FIG. 1A illustrates a schematic representation of a self-adjusting conductive male pin contact of a male connector sub-assembly of a connector assembly of the prior art, wherein an adjusting screw radially moves inwardly to actuate a Belleville washer mechanism.

FIG. 1A illustrates a schematic representation of a self-adjusting conductive male pin contact 10 (also referred to as conductive male pin contact) of a male connector sub-assembly of a connector assembly of the prior art. Referring to FIG. 1A, the self-adjusting conductive male pin contact 10 of the male connector element includes a body 02 having a distal end portion 02*d* and an adjustment mechanism configured at the distal end 02*d* for adjusting a diameter of the body 02. The adjustment mechanism is a Belleville washer adjustment mechanism that is positioned horizontally. More specifically, a pair of Belleville washers forming an Belleville washer arrangement 08 is disposed within a slot "S" configured on the body 02 of the conductive male pin contact 10 of the male connector sub-assembly, the Belleville washer adjustment mechanism includes an adjustment port 04*a* with threaded hole 04*b* configured on one side of the distal end 02*d* of the body 02 of the conductive male pin contact 10, wherein the port and the threaded hole 04*b* receives an adjustment screw 06 that radially moves within the conductive male pin contact 10 and actuates the Belleville washer arrangement 08 for adjusting the diameter of the conductive male pin contact 10. The access to the adjustment screw 06 is selective so that the adjustment of the conductive male pin contact's diameter can be performed by skilled and trained professionals only. More specifically, the connector assembly includes an adjustment port safety cap "C" for providing selective access to the adjustment screw 06 for permitting factory adjustment of the conductive male pin contact's diameter only. However, such configuration of the adjustment mechanism for adjusting the diameter of the conductive male pin contact 10 is ineffective because of limited contact between the Belleville of the Belleville washer arrangement 08 and the portions of the conductive male pin contact 10 separated by the slot "S" as contact is only at certain points and not a continuous contact. Further, the gap between the portions of the conductive male pin contact is increased to increase the diameter of the conductive male pin contact 10 by decompressing the Belleville washer arrangement 08 and is not controlled. Further, with such configuration the adjusting of the diameter of the conductive male pin contact 10 is not uniform along the contact length.

Figure 1B:
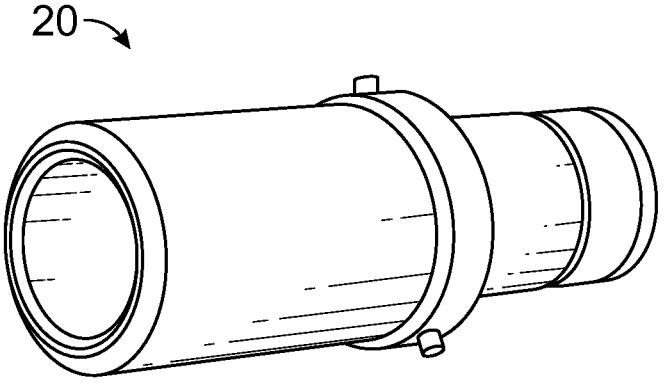
FIG. 1B (Prior Art)
FIG. 1B illustrates a schematic representation of a conductive female sleeve contact of a female connector sub-assembly of a connector assembly of the prior art, wherein the conductive female sleeve contact lacks a self-adjustment provision.

FIG. 1B illustrates a schematic representation of a conductive female sleeve contact 20 of a female connector sub-assembly of a connector assembly of the prior art. Referring to FIG. 1*b*, the conductive female sleeve contact 20 of the female connector sub-assembly does not have any provision for adjusting the dimension of the diameter of the conductive female sleeve contact 20 of the female connector sub-assembly.

Figure 2A:
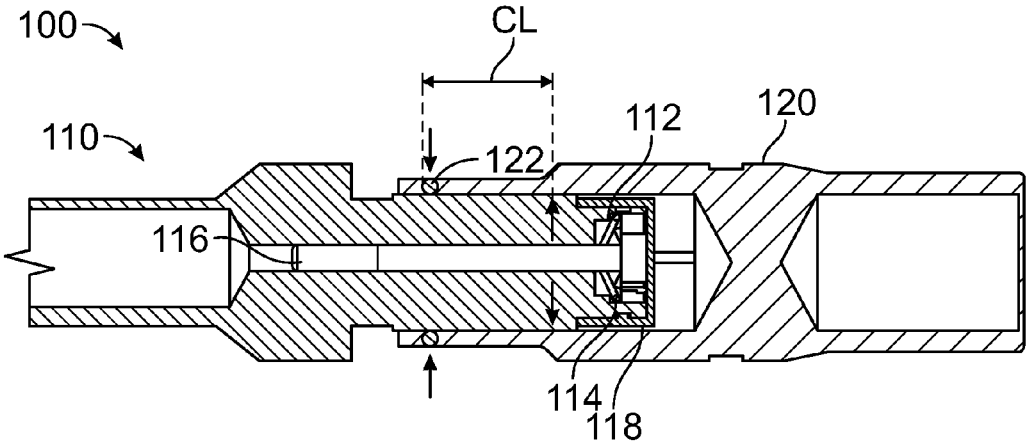
FIG. 2A illustrates a schematic representation of a self-adjusting conductive male pin contact of a male connector sub-assembly engaging with a self-adjusting conductive female sleeve contact of a female connector sub-assembly to configure a connector assembly.
Figure 2B:
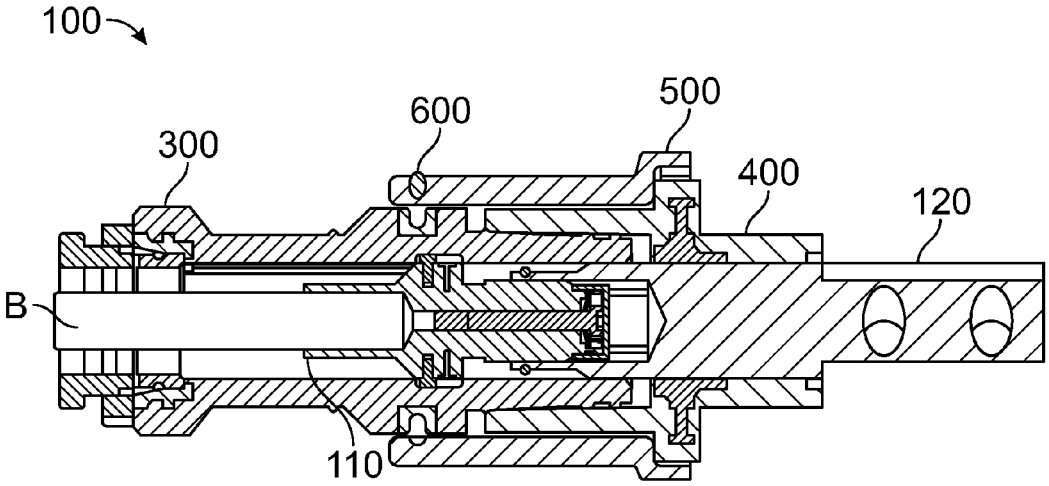
FIG. 2B illustrates a schematic representation of the connector assembly with the male connector sub-assembly thereof connected to a cable and a female connector sub-assembly thereof connected to a panel.

FIG. 2A illustrates a schematic representation of a self-adjusting conductive male pin contact 110 (also referred to as conductive male pin contact) of a male connector sub-assembly engaging with a self-adjusting conductive female sleeve contact 120 (also simply referred to as conductive female sleeve contact) of a female connector sub-assembly to configure a connector assembly in accordance with an embodiment of the present disclosure, wherein the conductive male pin contact 110 and conductive female sleeve contact 120 are self-adjusting and are also referred to as self-adjusting conductive male pin contact 110 and self-adjusting conductive female sleeve contact 120. In one embodiment, either of the conductive male pin contact 110 and conductive female sleeve contact 120 are self-adjustable for facilitating adjusting of external and internal dimensions thereof respectively. In accordance with another embodiment both of the conductive male pin contact 110 and conductive female sleeve contact 120 are self-adjustable for facilitating adjusting of external and internal dimensions thereof respectively. FIG. 2B illustrates a schematic representation of a connector assembly 100 with a male connector sub-assembly thereof connected to a cable "B" via a cable mount male plug 300 and a female connector sub-assembly thereof connected to a panel (not illustrated in the Figures) via a panel mount receptacle 400. More specifically, the male connector sub-assembly and the female connector sub-assembly are provided with provision for wire crimping or soldering at ends thereof for facilitating connection thereof with the cable or the panel mount (not illustrated in the Figures). The assembly of the cable and the panel via the connector assembly 100 is facilitated by a receptacle housing 500 that receives the connector assembly 100 and a clevis pin 600 that circumscribes the receptacle housing 500 and urges the receptacle housing 500 radially inwards to tightly grip the connector assembly 100 connected at one end to the cable at the male connector sub-assembly end and the panel at the female connector sub-assembly end to ensure holding together of the male and female connector sub-assemblies, thereby preventing any chances of accidental disengagement of the male and female connector sub-assemblies. In accordance with one embodiment, the clevis pin 600 is a U-shaped clevis pin that that locks together the male and female connector sub-assemblies eliminating the possibility of electrical shock hazards and disruption of services caused due to accidental disengagement of the male and female connector sub-assemblies. The male connector sub-assembly includes the conductive male pin contact 110 at front and base portion for electrical wire termination or connection with an insulated cover body assembled over the conductive male pin contact 110. The female connector sub-assembly includes the conductive female sleeve contact 120 at the front and base portion for electrical wire termination or connection with an insulated cover body assembled on the conductive female sleeve contact 120. The insulated cover body or synthetic rubber insulators for the conductive male pin contact 110 and the conductive female sleeve contact 120 of the male and female connector sub-assemblies respectively shield and insulate the conductive male pin contact 110 and the conductive female sleeve contact 120. The insulated cover body or synthetic rubber insulators extend past the ends of the conductive male pin contact 110 and the conductive female sleeve contact 120 of the respective male and female sub-assemblies for ensuring safety. In accordance with an embodiment of the present disclosure the conductive male pin contact 110 is shrouded by an insulator cover body and the conductive female sleeve contact 120 is shrouded by another insulated cover body.

Figure 3A:
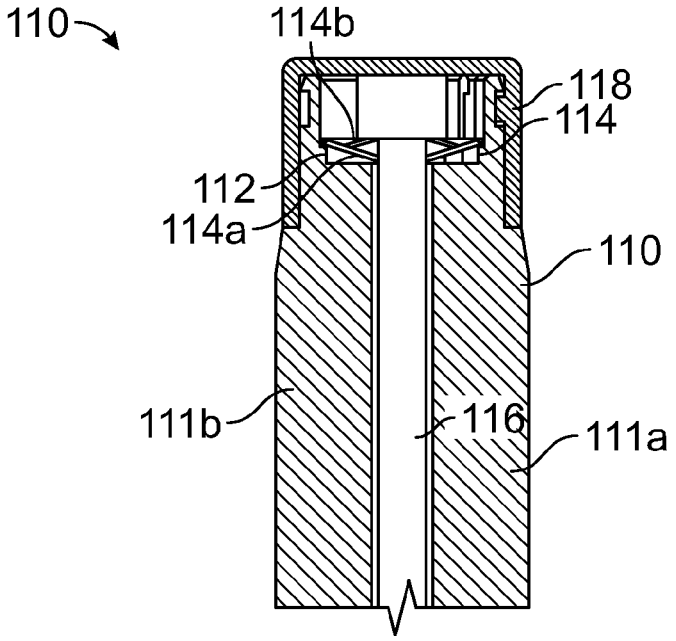
FIG. 3A illustrates an enlarged view of the self-adjusting conductive male pin contact of FIG. 2A, wherein a radially adjusting mechanism of the self-adjusting conductive male pin contact is a Belleville washer sub-assembly.

Referring to FIG. 2A and FIG. 3A, the self-adjustable conductive male pin contact 110 also referred to as the conductive pin has a first portion 111*a* and a second portion 111*b* configured by longitudinally bifurcating the conductive male pin contact 110. Further, the conductive male pin contact 110 includes a chamfered portion 112 that is generally in form of an axially extended stepped cavity, a radially adjusting mechanism that could either be a Belleville Washer arrangement 114 or a conical spring sub-assembly that includes a conical spring element 215 and an adjusting screw 116. In accordance with an embodiment, the conductive male pin contact 110 has a non-uniform cross-section with a maximum diameter at an operative top end and a minimum diameter at an operative bottom end thereof. In accordance with an embodiment, the first and the second portion 111*a* and 111*b* are identical as the first and second portions 111*a* and 111*b* are configured by longitudinally bi-furcating the conductive male pin contact 110 along a plane passing through center of the conductive male pin contact 110. In accordance with another embodiment, the first and the second portion 111*a* and 111*b* are non-identical as the first and second portions 111*a* and 111*b* are configured by longitudinally bi-furcating the conductive male pin contact 110 along a plane passing offset from the center of the conductive male pin contact 110.

The Belleville Washer arrangement 114 includes vertically positioned two unequal Belleville washers. FIG. 3A illustrates an enlarged view of the self-adjusting conductive male pin contact 110 of the male connector sub-assembly, wherein the radially adjusting mechanism of the self-adjusting conductive male pin contact 110 is the Belleville washer arrangement 114 also referred to as the Belleville washer sub-assembly 114. More specifically, the Belleville washer arrangement 114 includes an operative bottom Belleville washer 114*a* and a top Belleville washer 114*b*. The operative bottom Belleville washer 114*a* rests on the chamfered portion 112 configured at an end portion of the body of the conductive male pin contact 110. When the adjustment screw 116 is tightened, the top Belleville washer 114*b* is urged against the operative bottom Belleville washer 114*a* and the operative bottom Belleville washer 114*a* exerts force on the two halves 111*a* and 111*b* of the conductive male pin contact 110 that results in an increase in diameter of the conductive male pin contact 110. The top Belleville washer 114*b* acts as a biasing element to increase or decrease the gap between two halves 111*a* and 111*b* of the conductive male pin contact 110. More specifically, the operative bottom Belleville washer 114*a* rests on the chamfered portion 112 and is functionally coupled to the first and second portions 111*a* and 111*b* of the self-adjustable conductive male pin contact 110. The operative top Belleville washer 114*b* is spaced from the operative bottom Belleville washer 114*a* and is moved relative to the operative bottom Belleville washer 114*a* by the adjustment screw 116 as the adjustment screw 116 is tightened to cause radial movement of the operative bottom Belleville washer 114*a* for facilitating adjusting of gap between the first and second portions 111*a* and 111*b* of the self-adjustable conductive male pin contact 110, thereby adjusting the conductive male pin contact's external diameter. Such configuration of the adjustment mechanism for adjusting the conductive male pin contact's external diameter is effective because of comparatively more contact between the Belleville of the Belleville washer arrangement 114 and the portions 111*a* and 111*b* of the conductive male pin contact 110 separated by the slot. Further, with such configuration the gap between the portions 111*a* and 111*b* of the conductive male pin contact 110 is increased to increase the diameter of the conductive male pin contact 110 by compressing the Belleville washer arrangement 114 that is more accurate and controlled. Further, with such configuration the conductive male pin contact's diameter can be uniformly increased throughout the length thereof for ensuring a tight fit between the conductive male pin contact 110 and the conductive female sleeve contact 120 along the contact length. In accordance with an embodiment the adjustment screw 116 engages with an axial hole configured on the conductive male pin contact 110 for facilitating adjusting of the gap between the first and second portions 111*a* and 111*b* of the self-adjustable conductive male pin contact 110, thereby adjusting the conductive male pin contact's external diameter. The conductive male pin contact 110 of the male connector sub-assembly of the connector assembly includes a safety cap 118 for providing selective access to the adjustment screw 116 for permitting factory adjustment of the conductive male pin contact's external diameter only.

Figure 3B:
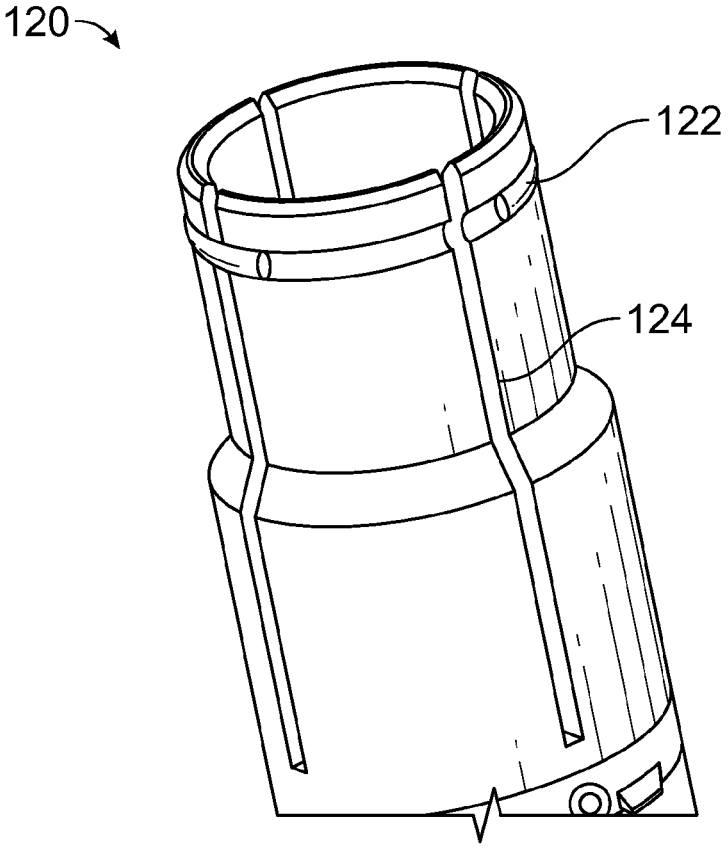
FIG. 3B is an enlarged view of the self-adjusting conductive female sleeve contact of the female connector sub-assembly, wherein a plurality of longitudinal slits are configured thereon and a spring element circumscribing the conductive female sleeve contact urge the conductive female sleeve contact radially inwards.

The connector assembly 100 also includes a female connector sub-assembly which in turn includes a self-adjustable conductive female sleeve contact 120 that has provision for adjusting the internal dimension thereof. FIG. 3B is an enlarged view of the self-adjusting conductive female sleeve contact 120, wherein a plurality of longitudinal slits 124 configured thereon and a spring element 122 circumscribing the self-adjustable conductive female sleeve contact 120 facilitate urging of the self-adjustable conductive female sleeve contact 120 radially inwards. More specifically, the conductive female sleeve contact 120 has two longitudinal slits 124 extending along contact length "CL" of the conductive female sleeve contact 120 and the spring element 122 circumscribing the conductive female sleeve contact 120 urges the conductive female sleeve contact 120 radially inwards towards the conductive male pin contact 110 received therein to maintain contact force between the conductive male pin contact 110 and the conductive female sleeve contact 120. With such configuration of the conductive male pin contact 110 and the conductive female sleeve contact 120 the insertion force is reduced and good contact between the conductive male pin contact 110 and the conductive female sleeve contact 120 is maintained. Further, such configuration of the conductive female sleeve contact 120 also improves the service life of the connector assembly 100 as low insertion force causes less wear.

FIG. 4A illustrates an enlarged view of a self-adjusting conductive male pin contact 210, wherein the radially adjusting mechanism of the self-adjusting conductive male pin contact 210 is a conical spring sub-assembly that includes the conical spring element 215 illustrated in a non-compressed configuration in FIG. 4A.

FIG. 4B illustrates an enlarged view of the self-adjusting conductive male pin contact 210, wherein the conical spring element 215 is illustrated in a compressed configuration and a safety cap 218 is assembled to an end portion of the self-adjusting conductive male pin contact 210 for providing selective access to an adjustment screw 216. The conical spring sub-assembly used for adjusting the dimension of the self-adjusting conductive male pin contact 210 includes the conical spring element 215 and a washer 214. The conical spring element 215 rests inside the conical cavity configured on an operative top end of the self-adjusting conductive male pin contact 210 and is functionally coupled to the first and second portions 211*a* and 211*b* of the self-adjusting conductive male pin contact 210. The washer 214 is disposed over the conical spring element 215 and is moved relative to the conical spring element 215 by the adjustment screw 216 to cause compression of the conical spring element 215 along axial direction "A" illustrated in FIG. 5 to cause radial movement of the conical spring element 215 along direction "R" illustrated in FIG. 5 for facilitating adjusting of the gap between the first and second portions 211*a* and 211*b* of the self-adjusting conductive male pin contact 210, thereby adjusting the external dimension of the self-adjusting conductive male pin contact 210. In accordance with an embodiment, the adjustment screw 216 engages with an axial hole configured on the self-adjusting conductive male pin contact 210 for facilitating adjusting of the gap between the first and second portions 211*a* and 211*b* of the self-adjusting conductive male pin contact 210, thereby adjusting conductive male pin contact's external diameter.

TECHNICAL ADVANTAGES AND ECONOMICAL SIGNIFICANCE

The technical advancements offered by the connector assembly of the present disclosure include the realization of:

- a connector assembly having self-adjusting male and female connector sub-assemblies for improving contact and achieving necessary fit between the engaging elements of the male and female connector sub-assemblies;
- a connector assembly that ensures uniform contact force between the contact surfaces of the conductive male connector pin and conductive female sleeve of the respective male and female connector assemblies along the length of the connector assembly;
- a connector assembly having such a configuration that permits factory adjustment of engaging elements, particularly, conductive male connector pin and conductive female sleeve of respective male and female connector sub-assemblies thereof by skilled and trained professionals only and restrains field adjustment of the engaging elements;
- a connector assembly that prevents unintentional disengagement between conductive male connector pin and conductive female sleeve of respective male and female connector sub-assemblies of the connector assembly;

a connector assembly that is simple in construction and convenient to use;

a connector assembly that is reliable;

a connector assembly that requires minimum maintenance;

a connector assembly that is tamper resistant;

a connector assembly that maintains necessary fit between the engaging elements of the male and female connector sub-assemblies even after regular and pro-longed service and exhibits enhanced service life;

a connector assembly that has ergonomic construction and that permits convenient release of a connection between engaging elements of the male and female connector sub-assemblies of the connector assembly when intended;

a connector assembly that is easy to use and configures a secure connection between male and female sub-assemblies of the connector assembly;

a connector assembly that is having quick connect feature for achieving quick assembly between male and female sub-assemblies of the connector assembly;

a connector assembly that ensures better surface contact between conductive male connector pin and conductive female sleeve of respective male and female connector sub-assemblies while still requiring lesser insertion forces, thereby enhancing the service life of the connection assembly;

a connector assembly that eliminates chances of field adjustment by unskilled field operators by not providing any provision for field adjustment, thereby reducing assembly time and eliminating the risks of accidents, disruption of services due to improper fitment of engaging elements of male and female connector sub-assemblies thereof by unskilled field operators; and a connector assembly that provides interchangeability with existing connector assembly already being used.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

Any discussion of materials, devices or the like that has been included in this specification is solely for the purpose of providing a context for the disclosure. It is not to be taken as an admission that any or all of these matters form part of the prior art base or were common general knowledge in the field relevant to the disclosure as it existed anywhere before the priority date of this application.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

We claim:

1. A connector assembly comprising:

a male connector sub-assembly comprising:

a conductive male pin contact having a first and a second portion configured by longitudinally bifurcating said conductive male pin contact, said conductive male pin contact comprising:

a chamfered portion axially configured on said conductive male pin contact;

a radially adjusting mechanism received within said chamfered portion and adapted to move said first and second portions of said conductive male pin contact relative to each other; and an adjustment screw axially passing through said conductive male pin contact and adapted to interact with and radially move said radially adjusting mechanism to adjust the gap between said first and second portions to adjust the conductive male pin contact's external diameter; and an insulated cover body assembled over said conductive male pin contact;

a female connector sub-assembly comprising:

a conductive female sleeve contact having a tubular configuration adapted to receive said conductive male pin contact, said conductive female sleeve contact further having a plurality of longitudinal slits configured thereon, wherein walls of said conductive female sleeve contact are adapted to be urged radially inwards towards said conductive male pin contact received therein to maintain contact there-between by a spring element circumscribing said conductive female sleeve contact; and an insulated cover body assembled on said conductive female sleeve contact.

2. The connector assembly as claimed in claim 1, wherein either of said conductive male pin contact and conductive female sleeve contact of the respective male and female connector assemblies are self-adjustable for facilitating adjusting of respective external and internal diameters thereof.

3. The connector assembly as claimed in claim 1, wherein both of said conductive male pin contact and conductive female sleeve contact of the respective male and female connector assemblies are self-adjustable for facilitating adjusting of respective external and internal diameters thereof.

4. The connector assembly as claimed in claim 1, wherein said first portion and said second portion are identical as said first and second portions are configured by longitudinally bifurcating said conductive male pin contact along a plane passing through center of said conductive male pin contact.

5. The connector assembly as claimed in claim 1, wherein said first and said second portion are non-identical as said first and second portions are configured by longitudinally bifurcating said conductive male pin contact along a plane passing offset from said center of said conductive male pin contact.

6. The connector assembly as claimed in claim 1, wherein said radially adjusting mechanism is a Belleville washer sub-assembly comprising:

an operative bottom Belleville washer adapted to rest on said chamfered portion and functionally coupled to said first and second portions of said conductive male pin contact; and an operative top Belleville washer spaced from said operative bottom Belleville washer and adapted to be moved relative to said operative bottom Belleville washer by said adjustment screw to cause radial movement of said operative bottom Belleville washer for facilitating adjusting of the gap between said first and second portions of said conductive male pin contact, thereby adjusting conductive male pin contact's external diameter.

7. The connector assembly as claimed in claim 1, wherein said radially adjusting mechanism is a conical spring subassembly comprising:

a conical spring element adapted to rest inside a conical cavity configured on an operative top end of the conductive male pin contact and functionally coupled to said first and second portions of said male connector element; and a washer disposed over said conical spring element and adapted to be moved relative to said conical spring element by said adjustment screw to cause radial movement of said conical spring element for facilitating adjusting of gap between said first and second portions of said conductive male pin contact, thereby adjusting conductive male pin contact's external diameter.

8. The connector assembly as claimed in claim 1, further comprising a safety cap secured to an end portion of said conductive male pin contact for providing selective access to said adjustment screw for permitting factory adjustment of said conductive male pin contact only.

9. The connector assembly as claimed in claim 1, wherein said adjustment screw engages with a threaded hole that is axially extending through the conductive male pin contact.

10. The connector assembly as claimed in claim 1, wherein said conductive male pin contact and said conductive female sleeve contact are shrouded by insulated cover bodies.

* * * * *